US008083411B2

(12) United States Patent
Bergmann

(10) Patent No.: US 8,083,411 B2
(45) Date of Patent: Dec. 27, 2011

(54) PACKAGING IN THE FORM OF A BAG

(75) Inventor: Reinhard Bergmann, Wallenhorst (DE)

(73) Assignee: Bischof + Klein GmbH & Co. KG, Lengerich (DE)

( * ) Notice: Subject to any disclaimer, the term of this patent is extended or adjusted under 35 U.S.C. 154(b) by 933 days.

(21) Appl. No.: 12/043,147

(22) Filed: Mar. 6, 2008

(65) Prior Publication Data

US 2008/0152266 A1 Jun. 26, 2008

(51) Int. Cl.
*B65D 33/01* (2006.01)
*B65D 30/00* (2006.01)

(52) U.S. Cl. ..... 383/103; 383/107

(58) Field of Classification Search ..... 383/100–103, 383/45, 107, 32
See application file for complete search history.

(56) References Cited

U.S. PATENT DOCUMENTS

| | | | | |
|---|---|---|---|---|
| 3,302,859 | A * | 2/1967 | Perry | 383/103 |
| 3,309,006 | A | 3/1967 | Perry et al. | |
| 3,937,395 | A * | 2/1976 | Lawes | 383/45 |
| 5,493,844 | A * | 2/1996 | Combrink | 53/410 |
| 6,170,985 | B1 | 1/2001 | Shabram, Jr. et al. | |
| 6,199,602 | B1 * | 3/2001 | Maginot et al. | 141/59 |
| 2005/0281493 | A1 | 12/2005 | Heinemeier et al. | |
| 2007/0181459 | A1 | 8/2007 | Lindlbauer | |

FOREIGN PATENT DOCUMENTS

| | | | |
|---|---|---|---|
| DE | 102004026538 | A1 | 12/2005 |
| EP | 524539 | A1 * | 1/1993 |
| GB | 1401713 | | 7/1975 |
| JP | 09095367 | A * | 4/1997 |
| JP | 11079198 | A * | 3/1999 |
| WO | 2007/006060 | A1 | 1/2007 |

* cited by examiner

*Primary Examiner* — Jes F Pascua
(74) *Attorney, Agent, or Firm* — Gudrun E Huckett

(57) ABSTRACT

A packaging container has walls made of film defining an interior of the packaging container. At least a first one of the walls has two wall parts that overlap one another forming an inwardly positioned overlapping strip and an outwardly positioned overlapping strip and providing an intermediately positioned venting passage. The overlapping strips are connected to one another by a securing seam that extends along an edge of the inwardly positioned overlapping strip. The venting passage communicates through inner openings with the interior and through outer openings with the ambient. The outwardly positioned overlapping strip has no openings. At least one filter is provided with the outer openings of the venting passage and is positioned underneath the outwardly positioned overlapping strip in a flat arrangement.

9 Claims, 2 Drawing Sheets

PACKAGING IN THE FORM OF A BAG

BACKGROUND OF THE INVENTION

The invention concerns a container for packaging, in particular, in the shape of a bag or a sack. The packaging container comprises walls made of film of which at least one wall is comprised of two wall parts that overlap one another as an inwardly positioned and an outwardly positioned overlapping strips defining an intermediately positioned venting passage and that are connected to one another by a securing seam extending along the edge of the inwardly positioned overlapping strip. The venting passage communicates through inner openings with the interior of the container and through outer openings with the ambient.

A packaging of this type forming a bag or a sack is to be provided with venting means in order to allow air that is entrained during filling of the container with the filling material to escape but also to allow air or gases that are trapped in granular material or powder material or are being generated to be removed from the packaging in order to provide in this way a compact product that is tightly and closely wrapped by the packaging. Typical filling materials are granular material or powder, for example, cement, or also products in the field of food or animal feed, for example, starch; such products have a particle size range down to a few micrometers. The need for venting and degassing of such a packaging container conflicts with the requirements to enclose the filling material reliably and to prevent the filling material from escaping so as to prevent material loss as well pollution of the surroundings. Also, foreign material should not penetrate the packaging so that the contained filling material is not affected, wherein particularly the penetration of moisture through the packaging is to be prevented. Such requirements are to be fulfilled in practice by means of a packaging container that is as simple as possible, inexpensive and made of a suitable material with respect to manufacture and disposal.

SUMMARY OF THE INVENTION

It is an object of the present invention to provide a packing container that provides a simple and effective venting action and, at the same time, seals effectively with regard to moisture and other foreign materials, which packaging container can be mass-produced inexpensively by machine production primarily from film, in particular plastic (synthetic) film, and in the form of a bag or a sack tightly encloses even fine granular or powder materials.

According to the invention, this object is solved for a packaging container of the aforementioned kind in that the outwardly positioned overlapping strip is without outer openings and covers at least one filter provided with outer openings and positioned underneath in a flat arrangement.

In comparison to conventional packaging containers where the inner and outer openings are distributed across the surface area within the overlapping strips, a closed (no perforations) outwardly positioned overlapping strip has been found to be an effective emission protection for the filling material contained in the packaging; in particular, it is also an effective barrier with regard to ambient moisture. The outwardly positioned overlapping strip effectively covers the filter or perforated areas positioned underneath. This protective function of the outwardly positioned overlapping strip that has a closed outer surface is enhanced moreover in that in the case of a filled packaging container that is in particular bulging because of the contained filling material rests relatively tightly on the inwardly positioned overlapping strip and thus closes of the inner and outer openings positioned underneath. In this respect, the outwardly positioned overlapping strip can be fixed or spot-connected at points; however, it rests normally without such a fixation in the desired position.

A venting function is provided in that air or other gases escaping from the interior are able to lift the outwardly positioned overlapping strip off the inwardly positioned overlapping strip and can pass easily and quickly through a filter, preferably provided with a large surface area, arranged below the outwardly positioned overlapping strip. The possibility of designing the outer openings (as well as the inner openings) with a large surface area without worrying about moisture penetration provides a great filter permeability relative to gaseous materials even in the case of a filter that must be provided with fine pores in view of fine powder filling materials. This is advantageous primarily in the case of machine filling of a container in order to vent and also to compact filling material transported in a blower air stream or filling material that is still loosely packed and contains air during filling.

In particular in the case of a strip-shaped configuration of the overlapping areas and of the filter, there are appropriate possibilities, including the possibilities of manufacturing closed or open hose-like pre-products for a packaging container, for continuous machine production of the containers from film material in connection with filling, sealing, and individualizing on part of the filling apparatus according to the FFS method (form, fill, seal).

DESCRIPTION OF PREFERRED EMBODIMENTS

Figure 1:
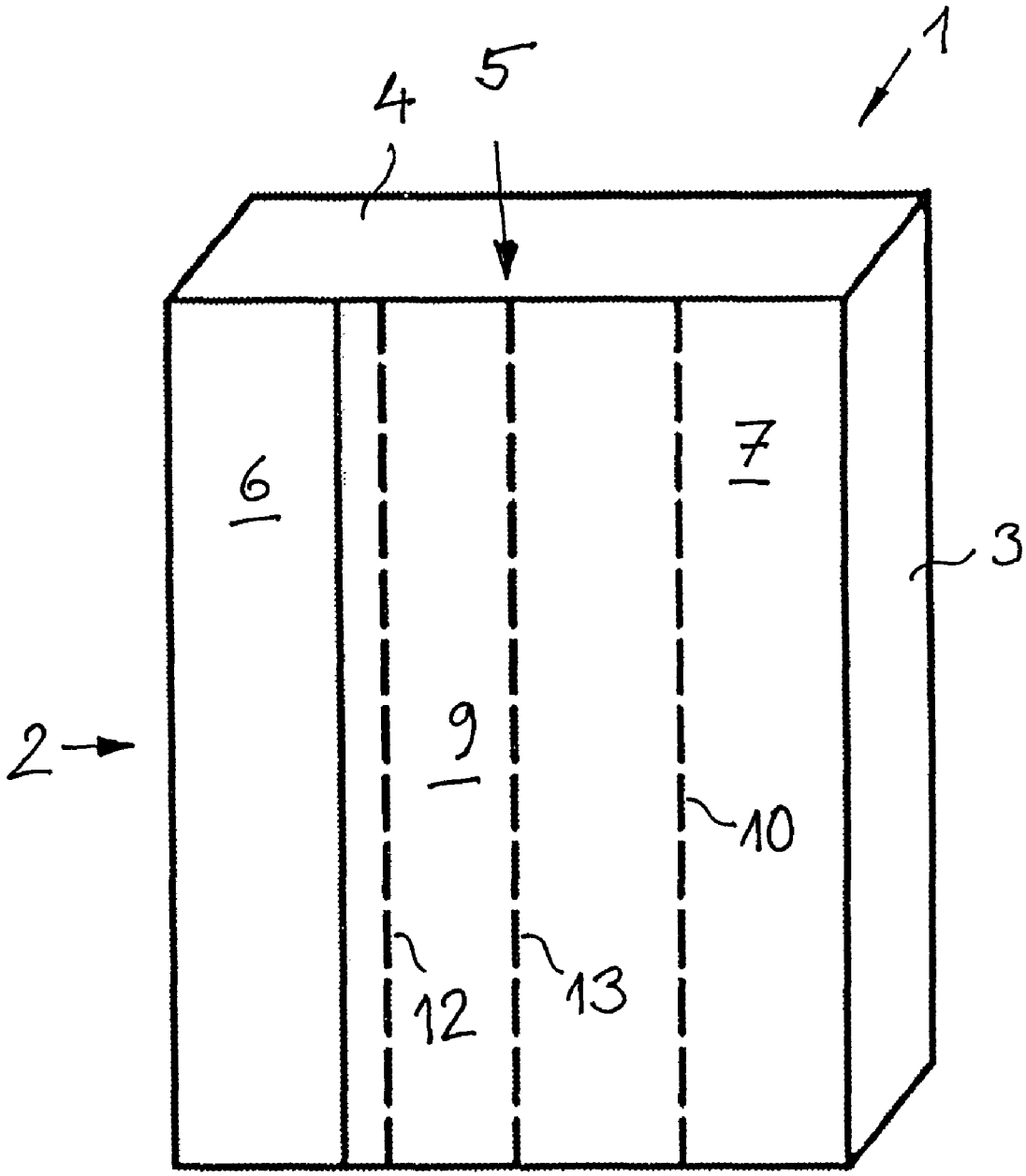
FIG. 1 shows a schematic perspective view of a packaging container according to the invention.

The packaging container referenced as a whole in FIG. 1 by numeral 1 is shown schematically in an idealized shape as a parallelepipedal body with visible walls 2, 3, 4. The wall 2 defines a main surface, the wall 3 is a narrow sidewall, and the wall 4 is a cover wall or end wall. The illustrated parallelepipedal shape of the container, manufactured from film material, is desirable in the context of compact and space-saving storage; however, this shape can be realized only under certain conditions in that by special longitudinal seams, lateral folds, bottom folds, and the like a shape is provided that approximates greatly the desired parallelepipedal shape. However, in deviation from the illustrated shape, the packaging container of the kind under consideration can be a simple flat bag that is comprised of a hose-shaped circumferentially closed film that is closed at the top and bottom by a simple transverse seam, respectively.

Figure 2:
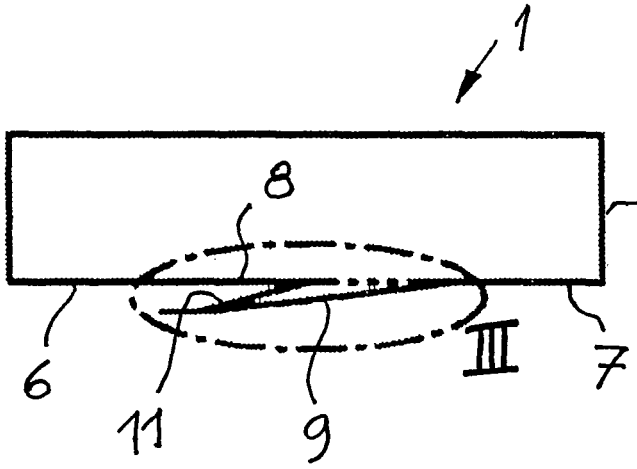
FIG. 2 is a cross-section view of a packaging container according to FIG. 1.

In any case, a venting possibility for the packaging container is to be provided with a passage 5 allowing air to pass at the front side 2. Two wall parts 6, 7 overlapping one another provide an inwardly positioned and an outwardly positioned overlapping strips 8 and 9. The inwardly positioned overlapping strip 8 is secured at its edge by means of a securing seam 10 relative to the wall part 7. The securing seam 10 defines the shape of the packaging container in the circumferential direction and ensures its integrity. As shown in FIG. 2, the wall parts 6, 7 can be opposed ends of a single film that is positioned in a hose shape and sealed by the securing seam 10.

The outwardly positioned overlapping strip 9 is thus a strip of the wall part 7 that projects past the securing seam 10; it covers the inwardly positioned overlapping strip 8 of the wall part 6 with an appropriate width.

Between the outwardly positioned and the inwardly positioned overlapping strips 9 and 8, a filter 11 is arranged and secured by sealing seams 12, 13 at the edges in such a way that the filter 11 together with the outwardly positioned overlapping strip 9 can lie flat against the inwardly positioned overlapping strip 8. Lying flat on top one another, the inwardly positioned overlapping strip 8 and the filter 11 are covered by the outwardly positioned overlapping strip 9; the strip 9 thus provides an excellent protection from contamination, mechanical damage and also from moisture of the areas underneath and in particular of the interior of the packaging container containing a filling material that is possibly moisture-sensitive or sensitive to pollutants.

Figure 3:
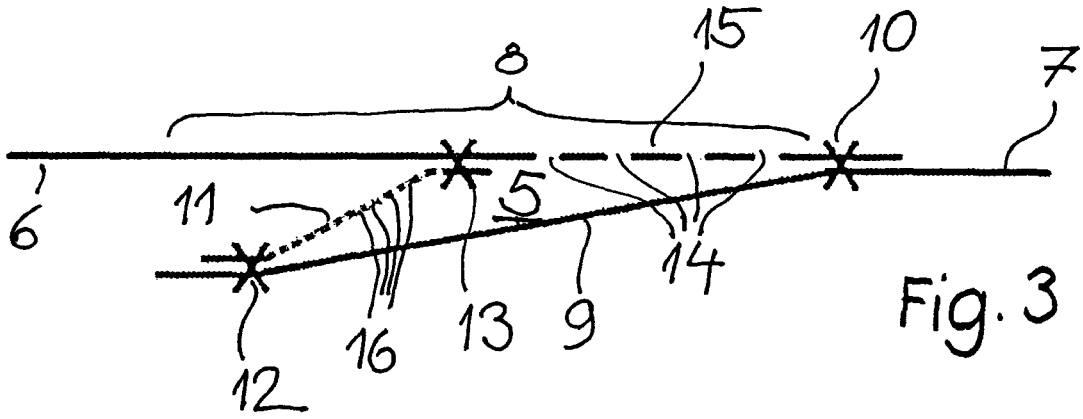
FIG. 3 shows detail III of FIG. 2.

In this connection, the filter 11 is protected by the outwardly positioned overlapping strip 9 in the arrangement illustrated in FIGS. 2 and 3 in which the sealing seam 13 for connecting the filter to the inwardly positioned overlapping strip 8 is positioned between the sealing seam 12 and the securing seam 10. In principle, this protective function would also be provided if the filter 11 were connected with a sealing seam spaced farther from the sealing seam 10 as a connection to the inwardly positioned overlapping strip and the sealing seam connecting it to the outwardly positioned overlapping strip were positioned on the other side moved toward the securing seam 10.

However, the illustrated embodiment has the advantage that the outwardly positioned overlapping strip 9 and the filter 11 upon pressure loading can unfold from the passage 5 into a wide open arrangement so that, with the filter being spread away from the inner overlapping strip 8, a large effective venting surface is provided.

In this respect, the filter 11 can be comprised of one or several partial filter surfaces; preferably, it is however provided as a continuous strip in terms of providing of large surface area. The large surface area is advantageous for a strong and easy venting action when appropriate fine filter openings, for example, for retaining fine granular filling material or powder filling material, are required that also prevent penetration of dirt or moisture even better, even though a permeability for air or gas as great as possible is to be realized.

While in the case of equilibrated pressure conditions between the interior of the packaging container and the ambient the outwardly positioned overlapping strip 9 rests flat across the inwardly positioned overlapping strip 8 and thereby protects and seals it, an overpressure in the interior leads to a valve-like spreading of filter and overlapping strip with the advantage of an easy passage of air. The latter holds true also for the passage of air or gas from the interior of the package to the passage 5 that is provided in the form of inner openings 14 in the form of perforations or needling in a strip-shaped area between the sealing seam 13 and the securing seam 10. Normally, these openings 14 are covered by the outwardly positioned overlapping strip 9 resting flat against the inwardly positioned strip 8, but are opened upon pressure loading from the interior.

It is understood that in place of perforations or needling in a strip 15 between the sealing seam 13 and the securing seam 10 other inner openings can also be provided, for example, by means of gaps in the securing seam 10. With regard to manufacturing technology as well as with regard to the aforementioned valve function the interior openings 14 in the strip 15 are however advantageous. Perforations or punched holes of the kind to be considered in this connection can be produced with well-known technical means by needling, punching, or laser perforation methods in a range of 40 micrometers up to more than one millimeter, and they provide with regard to fine granular or powder material no sufficient barrier with regard to loss or escape to the exterior. In contrast to this, by selecting the filter 11 appropriately, it is possible, as needed, to fulfill tighter specifications for outer openings 16 down to a few micrometers in the filter 11. In this regard, a filter having a predetermined mesh size and permeability made of plastic material or of paper can be provided. In particular, a nonwoven, namely a film-like thin layer of plastic material of random-pattern layers is possible. Expediently, the plastic material of the filter is matched to the material of the film of the packaging material so as to provide for unmixed recycling and excellent sealing and welding properties. An especially beneficial situation results when polyolefin plastic materials are selected, for example, polyethylene or polypropylene for filter and film.

Figure 4:
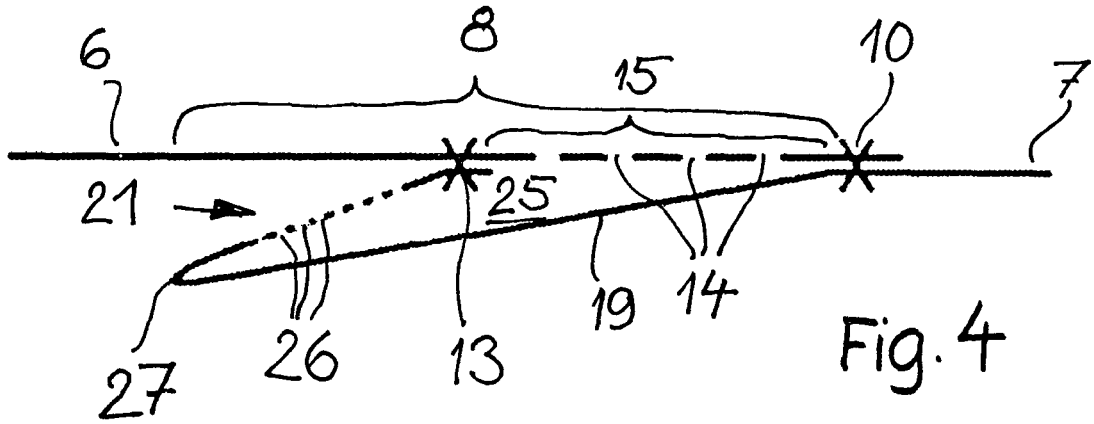
FIG. 4 shows an alternative embodiment in a section view like the section view of FIG. 3.

Another embodiment according to FIG. 4 is basically identical with the embodiment according to FIGS. 1 to 3 and differs essentially from the afore described embodiment in that the outwardly positioned overlapping strip 19 is folded back inwardly to form a strip-shaped filter 21 and in that the free end of the inwardly folded strip portion of the overlapping strip 19 is connected with a sealing seam, identified by numeral 13, to the inwardly positioned overlapping strip 8. The edge 27 of the folded strip portion forms in place of the sealing seam 12 the connection to the filter 21 relative to the outwardly positioned overlapping strip 19. The use of same reference numerals as in the embodiment of FIGS. 1 to 3 indicates same parts.

The filter strip 21 produced by folding eliminates welding or sealing connections between filter and overlapping strip 19. However, the filter 21 must then be provided with outer openings 26 that are to be produced in the film in the same way as the inner openings 14 by needling, punching, laser perforation methods or the like. As illustrated, the outer openings 26 are also finer than the inner openings 14; this facilitates in particular for a large filter surface area an easy, essentially bottleneck-free passage. It is understood that the openings in both situations can be configured to be the same or approximately the same and that the inner openings can also be selected to be smaller in order to prevent escape of filling material in the passage 25 between the overlapping strips.

In both embodiments the securing and sealing seams 10, 12, 13 can be limited basically to a part of the corresponding (front) wall or limited in portions to several parts; however, with regard to manufacturing technological considerations, it is usually preferred to produce the seams and strips across the length of the entire wall wherein also continuous filter strips and continuous perforations or needling are to be provided and sealing of the ends of the filter 11 or 21 is to be provided optionally by transverse seals or transverse welds applied to the bag. The overlapping strips extend preferably in the direction of the major length of the packaging container, i.e., in the case of a bag with rectangular walls parallel to the long edges of the largest walls. The continuous shape of the overlapping strips and of the filter has also the advantage that bulging of the packaging container resulting from filling causes an excellent contact and thus excellent coverage by means of the outwardly positioned overlapping strip.

While specific embodiments of the invention have been shown and described in detail to illustrate the inventive principles, it will be understood that the invention may be embodied otherwise without departing from such principles.

What is claimed is:

1. A packaging container comprising:

walls made of film defining an interior of the packaging container, wherein at least a first one of the walls is comprised of two wall parts that overlap one another forming an inwardly positioned overlapping strip and an outwardly positioned overlapping strip and providing an intermediately positioned venting passage, wherein the overlapping strips are connected to one another by a securing seam that extends along an edge of the inwardly positioned overlapping strip;

wherein the venting passage communicates through inner openings with the interior and through outer openings with the ambient;

wherein the outwardly positioned overlapping strip has no openings;

at least one filter provided with the outer openings of the venting passage, wherein the at least one filter is positioned underneath the outwardly positioned overlapping strip in a flat arrangement;

wherein the at least one filter is seal-tightly connected to the outwardly positioned and the inwardly positioned overlapping strips, wherein a first sealing seam connecting the at least one filter to the inwardly positioned overlapping strip is positioned between a connection of the at least one filter to the outwardly positioned overlapping strip and the securing seam.

2. The packaging container according to claim 1, wherein the at least one filter is strip-shaped and is arranged lengthwise along the overlapping strips.

3. The packaging container according to claim 2, wherein the at least one filter is comprised of a fine-pore flat filter material, wherein the connection of the at least one filter to the outwardly positioned overlapping strip is a second sealing seam.

4. The packaging container according to claim 2, wherein the at least one filter is comprised of a folded strip portion of the outwardly positioned overlapping strip which strip portion is folded inwardly and is provided with the outer openings, wherein the folded strip portion is connected by the first sealing seam to the inwardly positioned overlapping strip.

5. The packaging container according to claim 2, wherein the inwardly positioned overlapping strip is provided with the inner openings and wherein the inner openings are arranged between the securing seam and the first sealing seam.

6. The packaging container according to claim 1, wherein the securing seam is provided with gaps that form the inner openings.

7. The packaging container according to claim 1, wherein the overlapping strips extend in a direction of a major length of the packaging container.

8. The packaging container according to claim 1, wherein the securing seam and the first sealing seam extend parallel to one another across an entire length of the first one of the walls.

9. The packaging container according to claim 1, wherein the connection of the at least one filter to the outwardly positioned overlapping strip is a second sealing seam, wherein the securing seam and the first and second sealing seams extend parallel to one another across an entire length of the first one of the walls.

* * * * *